United States Patent [19]

Crivelli et al.

[11] Patent Number: 4,846,677

[45] Date of Patent: Jul. 11, 1989

[54] CASTABLE BUTTRESS FOR ROTARY KILN HEAT EXCHANGER AND METHOD OF FABRICATING

[75] Inventors: Raymond J. Crivelli, Pittsburgh, Pa.; Roger Snellman, Strongsville, Ohio

[73] Assignee: Dresser Industries, Inc., Dallas, Tex.

[21] Appl. No.: 231,072

[22] Filed: Aug. 11, 1988

[51] Int. Cl.[4] ..... F27B 7/14; F27B 7/28

[52] U.S. Cl. ..... 432/118; 432/119

[58] Field of Search ..... 432/103, 104, 105, 107, 432/110, 114, 118, 119

[56] References Cited

U.S. PATENT DOCUMENTS

| | | | |
|---|---|---|---|
| 2,889,143 | 6/1959 | Reaney et al. | 263/33 |
| 3,030,091 | 4/1962 | Wicken et al. | 432/119 |
| 3,169,016 | 2/1965 | Wicken et al. | 432/119 |
| 3,175,815 | 3/1965 | Wicken et al. | 432/119 |
| 3,201,100 | 8/1965 | Dussossoy | 263/33 |
| 3,455,099 | 5/1969 | Olsen et al. | 432/118 |
| 4,475,886 | 9/1984 | Tyler | 432/118 |

*Primary Examiner*—Henry C. Yuen

*Attorney, Agent, or Firm*—Edward G. Fiorito; William R. Peoples; Roy L. Van Winkle

[57] ABSTRACT

A buttress (52) for buttressing an axial end (34) of a partition (36) in a multiple-chamber heat exchanger (28) comprises an integral solid cast from a refractory material. A thick axial end (55) of the solid is provided for compressive engagement with an end (34) of the partition (36). A thin axial end (56) opposite the thick end (55) is provided for compressive engagement to a kiln shell liner (54). A radially outer surface (77) engages an inner surface (14) of the kiln shell (12). A radially inner surface (58) of the buttress (52) slopes generally from the thick end (55) to the thin end (56), such that compressive force exerted on the thick end by the partition (36) is transmitted through the buttress (50) to a liner (54) of the kiln shell (12).

7 Claims, 3 Drawing Sheets

CASTABLE BUTTRESS FOR ROTARY KILN HEAT EXCHANGER AND METHOD OF FABRICATING

TECHNICAL FIELD OF THE INVENTION

The present invention relates in general to rotary kilns, and more particularly to discharge-end buttresses for multiple-chamber heat exchangers in rotary kilns and methods of fabricating these buttresses.

BACKGROUND OF THE INVENTION

Rotary kilns having multiple-chamber heat exchangers are well known in the art for purposes such as calcining of calcium carbonate in the production of commercial lime. Representative multiple-chamber heat exchanger rotary kilns are shown in U.S. Pat. No. 2,889,143 issued to W. A. Reaney et al. and U.S. Pat. No. 3,201,100 issued to P. Dussossoy. These patents in particular disclose three- and four-chamber heat exchangers for use inside rotary kilns. A trefoil heat exchanger is a particularly common form.

Rotary kilns are typically built within steel cylindrical shells that have an intake end elevated a small height above a discharge end thereof. Aggregate material is fed into the intake end of these rotary kilns, the shell is rotated, the aggregate material processed and the material discharged out the discharge end. A trefoil heat exchanger is conventionally built at some distance along the axis of the cylindrical shell inwardly from the intake end.

Preferred constructions of trefoil heat exchangers are built of refractory brick and are mortared and keyed such that they will stay in place upon rotation. While integral castable trefoil constructions have been tried, it has been found that they are unable to sufficiently resist longitudinal flexure due to the rotation of the kiln. Precast trefoils crack due to this flexure. Because they are not keyed in place, pieces of the cracked precast trefoil are apt to fall out. On the other hand, trefoil heat exchangers that are constructed of a plurality of firebricks yield at their mortar joints. Pieces of them are less likely to fall out because of the keyed nature of their assembly.

Because the rotary kiln shell has an intake end elevated above the discharge end, all components inside the kiln exert a compressive force toward the discharge end. To resist this compressive force and thus prevent the sliding of kiln components towards the discharge end, buttress blocks are conventionally provided at the low end of the partition walls at their juncture with the shell perimeter. These buttress blocks are generally formed of conventional refractory materials that are weaker in their cross-breaking strength than in their crushing strength. Shear forces develop in them as the heat exchanger applies compressive force, causing the cracking and the dropping-out of the buttress blocks. The failure of these buttress blocks leads to the downhill sliding of components of the heat exchanger, thereby reducing the heat exchanger's useful life. A need has therefore arisen for multiple-chamber heat exchanger buttresses that will not fail due to shear forces but will transmit the compressive forces placed on them by the heat exchanger partitions to other components toward the discharge end of the rotary kiln.

SUMMARY OF THE INVENTION

One aspect of the invention comprises a buttress for buttressing an axial end of a partition in a multiple-chamber heat exchanger that is disposed in a tubular rotary kiln shell. The buttress comprises an integral solid that is cast from a refractory material. A thick axial end of the solid is adapted for abutting an end of the heat exchanger partition. An opposed, thin axial end of the solid is adapted for compressive engagement with a kiln shell liner. A radially outer face of the buttress extends from the thick axial end to the thin axial end, and is adapted for engagement with the inner surface of the kiln shell. A radially inner face of the buttress slopes generally from the thick end to the thin end such that compressive force exerted on the thick end by the partition is transmitted through the buttress to the liner.

Another aspect of the invention is directed to a method for buttressing a multiple-chamber heat exchanger within a rotary kiln. The multiple-chamber heat exchanger is formed within a shell of the kiln, including partition walls to define the chambers that extend from the kiln axis to the shell. A surface portion on an interior surface of the shell is defined to be adjacent a respective one of a plurality of axial ends of the partition walls. Within this surface portion, a plurality of buttress anchors are preferably joined to the wall to extend radially inwardly therefrom. A radially inner surface for each buttress is defined such that it will slope radially outwardly from a thick end adjacent a respective axial end of a partition wall to a thin end remote therefrom. The buttresses are formed out of a refractory material on the respective surface portions and to surround the anchors. A shell liner is formed on a portion of the interior surface of the shell toward the discharge end of the kiln and adjacent the thin ends of the buttresses, such that compressive force will be transmitted from the partitions through the buttresses to the liner.

BRIEF DESCRIPTION OF THE DRAWINGS

Further aspects of the invention and their advantages will be comprehended with reference to the following detailed description taken in conjunction with the drawings in which.

DETAILED DESCRIPTION OF THE INVENTION

Figure 1:
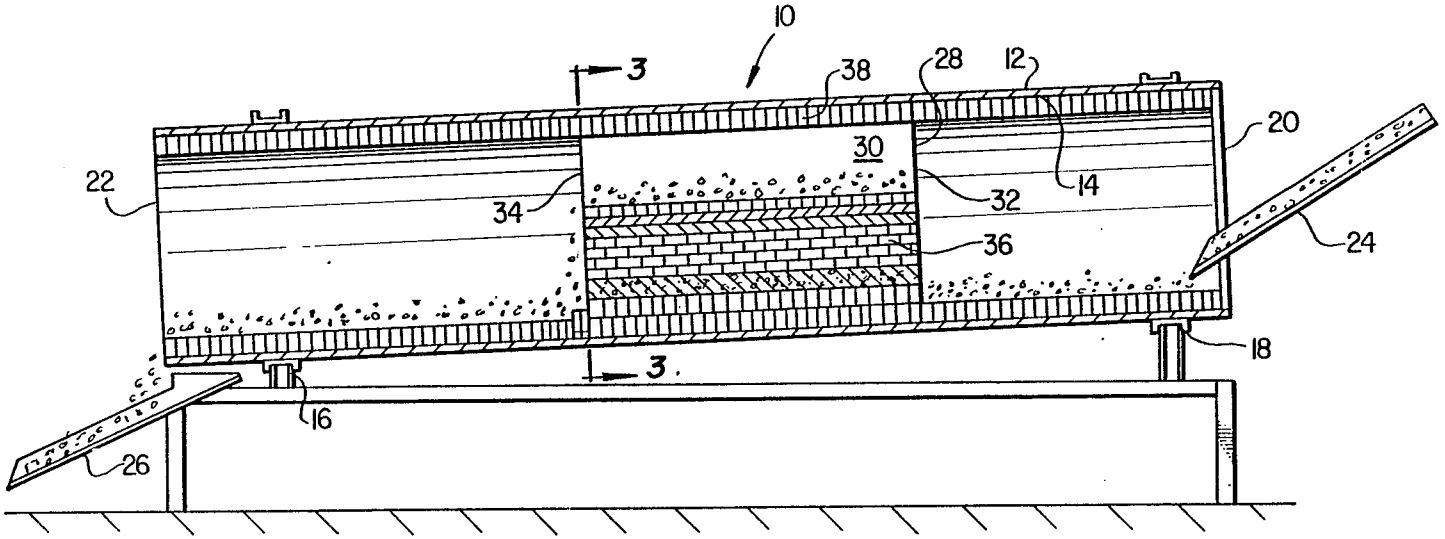
FIG. 1 is a schematic axial sectional view of a rotary kiln according to the prior art, showing the placement of a trefoil heat exchanger and brick buttress elements therein.

Referring first to FIG. 1, a rotary kiln according to the prior art is shown in axial sectional view generally at 10. Rotary kiln 10 has a hollow steel cylindrical shell 12 with an interior cylindrical surface 14. Shell 12 is supported as by rolling supports 16 and 18 such that shell 12 is inclined a small degree from the horizontal. An intake end 20 of the shell 12 is therefore above a discharge end 22 thereof. Material to be treated is introduced into kiln 10 by a chute 24 into the intake end 20.

The material is treated as it passes through kiln 10 and exits through a chute 26 at the discharge end 22.

In the illustrated example, a trefoil heat exchanger 28 is formed at some distance down into shell 12 so as to completely fill a predetermined cylindrical portion thereof. The illustrated heat exchanger 28 has three tubes or chambers 30 (one shown in FIG. 1) extending from an upstream end 32 of the heat exchanger to a downstream end 34. The longitudinal section in FIG. 1 is taken through one of three partition walls 36 that separate the tubes or chambers 30 from each other. A liner 38 lines each chamber 30 along the cylindrical surface 14 between the partitions 36. Liner 38, partitions 36, and the other components of heat exchanger 28 are fabricated from suitable firebrick or other refractory materials. Where firebricks are used, they are keyed and mortared so as to hold them in place while the kiln 10 rotates about its axis.

Figure 2:
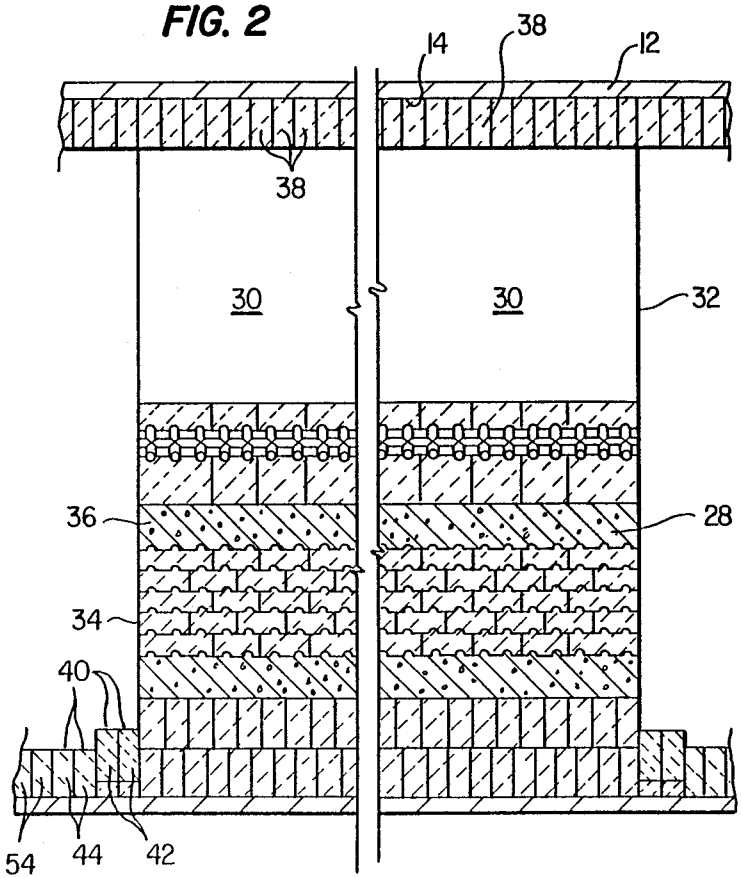
FIG. 2 is a detail of FIG. 1, showing the prior art brick buttress elements in more detail.

FIG. 2 is an axial sectional view of a heat exchanger as buttressed according to the prior art. Because kiln 10 is tilted downstream toward the discharge end 22 (FIG. 1), the heat exchanger 28 will exert a compressive force on the structural elements of the kiln downstream (to the left in FIG. 2) from it. According to the conventional design, a plurality of buttress blocks 40 are placed adjacent the downstream end 34 of each partition 36 of the heat exchanger 28 to resist this compressive force. As noted in the background of the invention, the conventional buttress blocks 40 have a tendency to crack and fall out when subjected to the shear forces created by heat exchanger 28.

Blocks 40 may be laid in two or more courses and may be stepped from a multiple-course portion 42 nearest the downstream end 34 of heat exchanger 28, to a series of single-course rows of buttress blocks 44 are disposed between the double-course block 42 and a refractory liner 54 (here constructed of further refractory blocks). Because buttress blocks 40 include several individual blocks, and because they are substantially rectangular in axial cross-section, bricks 40 will have a tendency to crack under the shear force and fall out upon rotation, thereby causing downstream movement of unsupported parts of the heat exchanger 28 and a shortening of its life.

Figure 3:
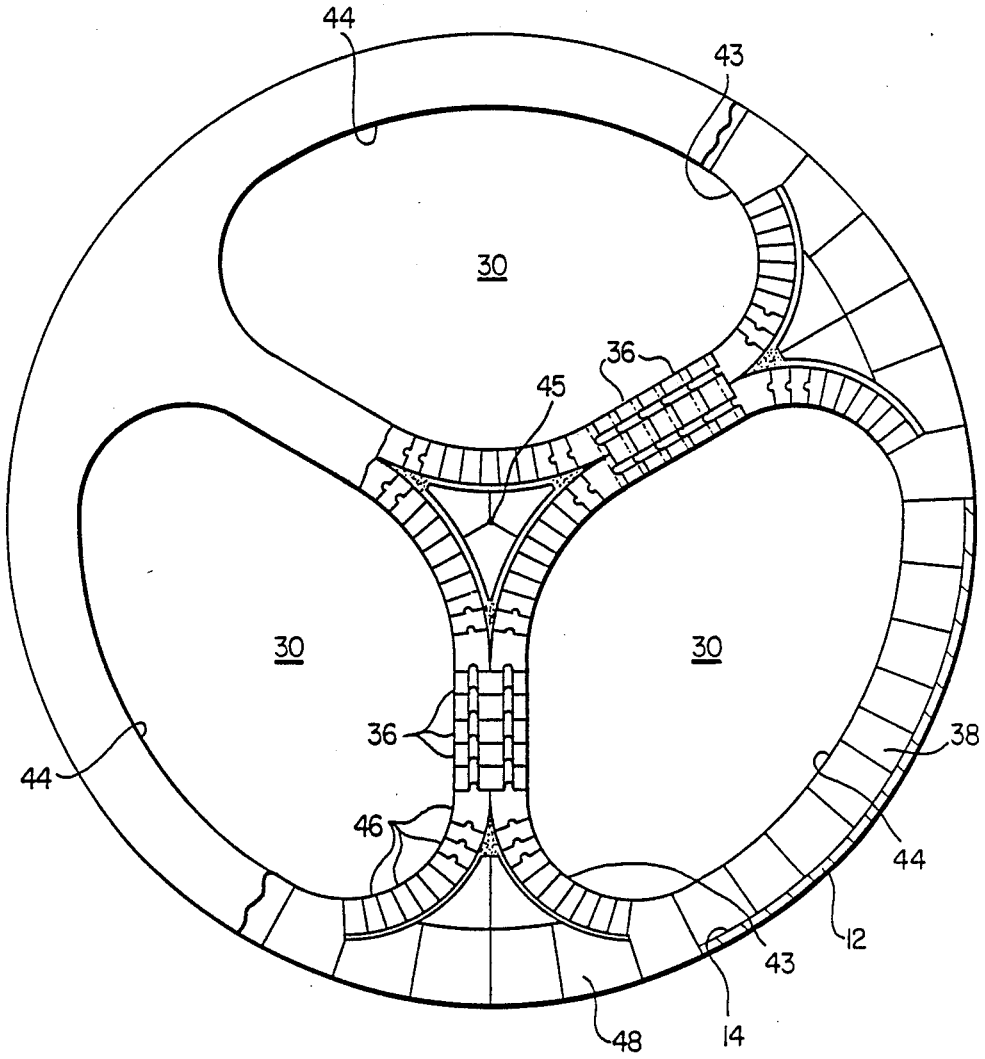
FIG. 3 is an end sectional view of the rotary kiln, taken substantially along line 3—3 of FIG. 1.

FIG. 3 is a sectional end view of the heat exchanger 28 and shell 12 taken along line 3—3 of FIG. 1. Each trefoil chamber 30 has an arcuate axial end margin 43, including a margin segment 44 that is disposed radially furthest away from the kiln axis 45. A plurality of small keyed refractory bricks 46 line each chamber 30 on or near the sides making up partitions 36. To support the curved portions of bricks 46, refractory blocks 47, 48, 49 and 50 are provided to fill out the circumference of shell 12.

Figure 4:
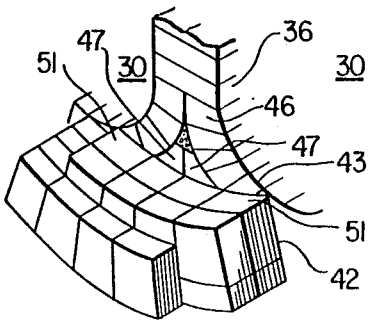
FIG. 4 is an isometric view of one of the heat exchanger partitions showing the placement of the prior art buttress blocks.

Turning now to FIG. 4, an isometric end view of the heat exchanger 28 of FIG. 3 is shown together with the placement of the prior art buttress blocks. Buttress blocks 42 are dimensioned to support each of blocks 47–50 (only portions of blocks 47 are visible) as well as many of the partition bricks 46. Because the upper course of buttress blocks 42 is roughly rectangular in shape, ends 51 thereof will protrude inwardly into the downstream volume that is a continuation of chambers 30. This will cause the end blocks of blocks 42 to prematurely wear.

Figure 5:
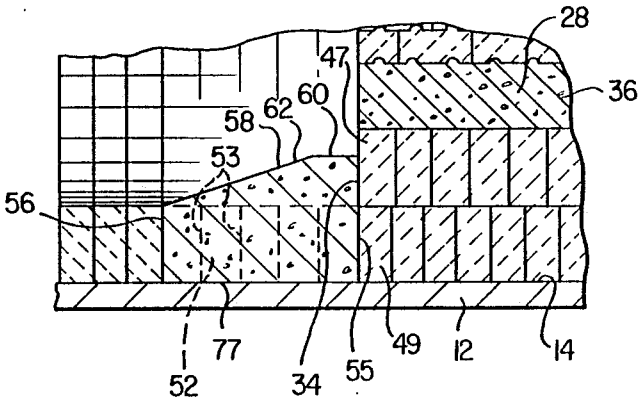
FIG. 5 is a schematic axial sectional view of a chamber partition end showing the use of an integral buttress according to the invention.

FIG. 5 is an axial sectional view of a portion of heat exchanger 28 showing the installation of one of a plurality of integral precast buttresses 52. One buttress element each is provided for each chamber partition 36 in the heat exchanger 28. Each buttress 52 is an integral solid that is preferably cast from fireclay and a calcium aluminate cement, or a high-alumina aggregate and a calcium aluminate cement. Other refractory materials may be used, such as an alumina-chrome castable material. The composition of each buttress 52 should also include steel wire whiskers for improved thermal shock resistance.

Each buttress 52 is affixed to the interior surface 14 of shell 12. This can conveniently be done by the provision of a plurality of steel anchors indicated schematically at 53. Anchors 53 may be positioned into a separate buttress form, and the buttress 52 may then be precast, with the anchors subsequently being threaded through appropriate holes (not shown) in shell 12 and bolted. Alternatively, buttress 52 can be performed by ramming a plastic refractory ramming mix leaving only three to four percent moisture, or the buttress 52 can be vibration-cast by tamping a semidry material. It is however preferred that anchors 53 be welded in place onto the interior surface 14 of shell 12 to extend radially inwardly, and the buttress 52 cast around them. The steel anchors 53 used can be of any suitable conventional type, such as christmas tree anchors.

Each buttress 52 is disposed between an end 34 of a partition 36 and a shell liner 54, here illustrated as composed by further refractory blocks. A thick, axially upstream end 55 of buttress 52 is adaptable to compressibly engage with the discharge end 34 of a respective partition 36. A thin, axially downstream end 56 is adapted to engage concrete liner 54, preferably throughout the thickness of liner 54. A radially inner face 58 of buttress 52 generally slopes radially outwardly from thick end 55 to thinner downstream end 56. In the particular embodiment shown, interior surface 58 includes a horizontal face 60 and a sloping face 62 that slopes axially in the discharge direction and radially outwardly until it meets thin end 56. Three buttresses 52 (only one shown) are placed around the circumference of shell 12 next to respective ends 34 of partitions 36, entirely replacing the buttress blocks 40.

The general sloping character of interior surface 58 of each buttress 52 assures that the compressive force exerted by each partition 36 of heat exchanger 28 is entirely transmitted to shell liner 54. This in turn assures that no shear forces are set up.

Figure 6:
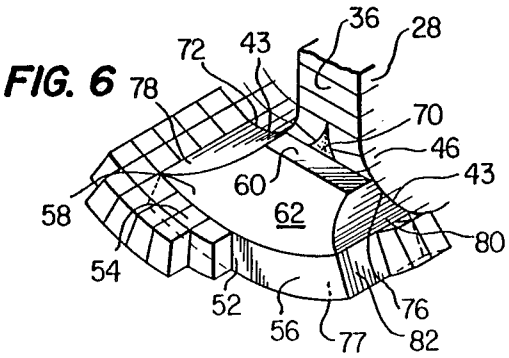
FIG. 6 is an isometric view of the partition end and buttress shown in FIG. 5.

Referring now to FIG. 6, an isometric end view of the heat exchanger 28 is shown with a representative placement of a buttress 52 with respect to one of the three trefoil partition walls 36.

Each buttress 52 is preferably shaped to resist any downstream movement of a number of bricks 46 and each of the blocks 47–50 (not shown; see FIG. 3). A radially inward central margin 70 of each buttress 52 is selected to resist the downstream compressive forces of these blocks. A curved margin 72 is provided for mating with a congruent segment of curved margin 43 of chamber 30. A curved margin 76 is likewise provided for mating with another congruent segment of a curved margin 43 of an adjacent chamber 30. Curved margins 72 and 76 are selected such that the minimum abrasion of particulate matter exiting from the heat exchanger 28 results.

While in the illustrated embodiment each buttress 52 is shown in bilaterally symmetrical alignment with respect to each respective partition 36, this need not be the case. Instead, each buttress 52 can be placed slightly off-center with respect to partition 36 in a direction opposite the direction of rotation of kiln 10. Hence, if kiln 10 were to rotate in a clockwise direction, each buttress 52 would be placed somewhat counterclockwise of the center line of partition 36. This is actually the preferred placement because the weight of carried particulate matter within the heat exchanger may cause a shifting of the center of compressive stress to a point displaced from the center line of the partition 36.

Each buttress element 52 has a radially exterior surface 77 for engagement to the interior surface 14 of shell 12. The outer cylindrical surface 77 of each buttress 52 runs between upstream end surface 55 and downstream end surface 56, which last two surfaces are preferably normal to radial exterior surface 77.

As previously noted, the radially interior surface 58 of buttress 50 includes a small flat face 60 immediately adjacent the discharge end 34 of partition wall 36, and a sloping face 62 extending from flat surface 60 to the thin end 56. The inner face 58 is completed by a pair of arcuate surfaces 78 and 80 that start from respective arcuate margins 72 and 76 and gradually decrease in area as they extend in a discharge direction. Surfaces 78 and 80 and arcuate margins 72 and 76 are chosen to minimize abrasion caused by the particulate material being processed by heat exchanger 28. While surface 62 slopes linearly in axial section, it is concave toward its margin with downstream end 56 so as to blend in with liner 54. Finally, a pair of surfaces 82 (one shown) complete the exterior of buttress 50, and are formed in parallel to respective radii of heat exchanger 28. Surfaces 82 key in to adjacent components such as non-buttressing liner components.

While the integral buttress of the invention has been shown as used with a heat exchanger with three chambers, the buttress can be used in any rotary refractory construction that uses partitions that are parallel to the rotational axis in whole or in part. For example, the buttress can be used, with minor modifications in shape, to buttress the downstream axial ends of rotary refractory constructions having from one to many partitions. The present invention and its advantages are in any case not limited to the embodiments described above but is instead defined only by the spirit and scope of the appended claims.

What is claimed is:

1. A rotary kiln, comprising;

an outer cylindrical shell for rotating about an axis thereof and having an interior surface defining a bore;

a refractory heat exchanger disposed in said bore to fill a transverse section thereof, a cylindrical wall of said heat exchanger mating a first circumferential portion of said interior surface of said shell;

a plurality of partitions each extending from said cylindrical wall radially inwardly to said axis to define a plurality of chambers formed axially through said exchanger;

said partitions each having an axial end, a plurality of buttresses joined to said interior surface of said shell and each having a thick end for buttressing a respective one of said axial ends of partitions, each buttress integrally formed from a refractory material; and a liner for lining a second circumferential portion of said interior surface of said shell, a thin end of each said buttress remote from said thick end and axially abutting said liner for transmitting compressive force thereto, a radially interior surface of each said buttress generally sloping from said thick end to said thin end.

2. The rotary kiln of claim 1, wherein said partitions are formed from a plurality of refractory bricks, each of said heat exchangers chambers having an axial margin formed by said bricks, said margin having at least one point furthest removed from said axis;

the thickness of said thick end of said buttress selected such that all refractory bricks forming said partition that are radially more remote from said axis than said point on said margin are abutted by said buttress.

3. The rotary kiln of claim 1, wherein each partition is formed to be bilaterally symmetrical with respect to a radial center line, said buttress formed to be substantially bilaterally symmetrical with respect to said center line.

4. The rotary kiln of claim 1, wherein each said partition is formed to be bilaterally symmetrical with respect to a center line, each said buttress formed off center from said center line in an angular direction opposite the direction of kiln rotation.

5. The rotary kiln of claim 1, wherein said heat exchanger comprises a trefoil heat exchanger with three partition walls, three buttresses formed to abut respective partition walls at angularly equidistant loci on said interior surface of said shell.

6. The rotary kiln of claim 1, and further comprising a plurality of anchors welded to said shell and extending radially inwardly from said interior surface, each said buttress formed around a respective plurality of said anchors.

7. A buttress for buttressing an axial end of a partition of a multiple-chamber heat exchanger within a tubular rotary kiln shell, comprising:

an integral solid cast from a refractory material;

a thick axial end of said solid, said partition dividing two tubular chambers of said heat exchanger from each other, each of said chambers having an axial margin, said thick end compressively engaging said end of said partition from at least the margin of one of said two chambers to at least the margin of the other of said two chambers;

a thin axial end of said solid opposite said thick end for compressive engagement with a kiln shell liner;

a radially interior surface of said kiln shell adjacent said heat exchanger and said liner, an outer radial surface of said solid extending from said thick axial end to said thin axial end for disposal adjacent said interior surface of said kiln shell; and a radially inner surface of said solid generally sloping radially outwardly from said thick end to said thin end, such that compressive force exerted on said thick end by said partition is transmitted through said solid to said liner.

* * * * *